United States Patent [19]

Andrien et al.

[11] 4,351,678

[45] Sep. 28, 1982

[54] METHOD OF MAKING CORROSION RESISTANT PHOSPHOROUS COPPER OR PHOSPHOROUS COPPER ALLOY PIPES

[75] Inventors: Yves Andrien, Embourg; Christian Triquet, Esneux, both of Belgium

[73] Assignee: Usines a Cuivre et a Zinc de Liege, Belgium

[21] Appl. No.: 175,749

[22] Filed: Aug. 6, 1980

[51] Int. Cl.[3] ..... C23F 7/02

[52] U.S. Cl. ..... 148/6.31; 72/41; 134/20; 134/22 C

[58] Field of Search ..... 148/6.31, 11.5 C, 13.2; 134/20, 22 C, 39; 72/39, 41, 274, 286, 367

[56] References Cited

U.S. PATENT DOCUMENTS 1,280,825 10/1918 Pacz ..... 134/20

2,620,286 12/1952 Shaw ..... 134/20

3,398,028 8/1968 Scott ..... 148/6.31

3,930,894 1/1976 Shapiro et al. ..... 148/11.5 C

*Primary Examiner*—Ralph S. Kendall

*Attorney, Agent, or Firm*—David S. Fishman

[57] ABSTRACT

An improved corrosion resistant pipe and method of manufacture is presented wherein a phosphorus copper or phosphorus copper alloy pipe is subjected to a special heat treatment step which forms an internal oxide coating. A pipe produced in accordance with the invention is characterized as having a carbon content on the inside wall of 0.05 mg/dm$^2$ or less and an internal oxide coating having a thickness ranging from 0.1 to 5 microns. Notably this improved pipe has a good resistance to corrosion, even when exposed to chemically agressive liquids.

3 Claims, 2 Drawing Figures

POTENTIAL DIFFERENCE
350 mV
300 mV
250 mV
200 mV
170 mV
150 mV
100 mV
FORMATION
SEVERE PITTING
SOME PITTING
WITHOUT PITTING
(STAGNANT DURATION 2 DAYS)
CARBON 0·16 mg/dm²
(STAGNANT DURATION 10 DAYS)
CARBON 0·45 mg/dm²
(STAGNANT DURATION 7 DAYS)
A>B
BURST?
CARBON 0·11 mg/dm²
CARBON 0·05 mg/dm²
CARBON 0·05 mg/dm²
TIME BY DATE
4-11
11-11
18-11
25-11
2-12
9-12
16-12
23-12
31-12
6-1
13-1
20-1
27-1
3-2
10-2
17-2
24-2
6-3
17-3
24-3
31-3
7-4
14-4
21-4
28-4
10-5

METHOD OF MAKING CORROSION RESISTANT PHOSPHOROUS COPPER OR PHOSPHOROUS COPPER ALLOY PIPES

BACKGROUND OF THE INVENTION

1. Field of the Invention

The present invention relates to pipes, particularly well suited for application in sanitary plumbing, made of phosphorus copper or phosphorus copper alloys and having good corrosion resistance properties. This invention also relates to a process of making such pipe.

2. Description of the Prior Art

Phosphorus copper or phosphorus copper alloy pipes are widely used in plumbing, particularly for hot and cold water pipes. Generally they are available in two forms, either as coils of annealed copper pipe or in a straight length. The pipes may be bare or provided with an insulating sheath of PVC, notably when they are designed to be embedded in concrete. Mostly they are made with a "clean" interior surface, that is to say, free from deposits.

It is well known in the art that in the course of fabricating these pipes, which includes a drawing operation between a die and a mandrel forming an annular space therebetween, the pipes come into contact with the drawing oil or lubricant. This lubricant is generally comprised of hydrocarbons, and is necessary for satisfactory operation of the drawing process. When such pipes are subsequently used in contact with chemically agressive liquids the appearance of pitting or of blisters is generally observed. Research has revealed that the carbon content of the interior surface of such pipes, which results from the distillation and decomposition of the drawing oils, particularly during the annealing process, generally increases the corrosion tendencies of the pipes. It is generally accepted that it is undesirable for the carbon content to exceed 2 mg/dm$^2$.

The prior art discloses various methods of eliminating the drawing oil residues and especially avoiding the formation of carbon deposits derived from these oils.

One such method involves injecting into the pipes, prior to annealing, a degreasing agent such as trichloroethylene. This reduces residual oil which give rise to carbon deposits. After the degreasing fluid is passed through the pipe a current of steam is blown through the pipe to sweep out any residual traces of the solvent.

Another method involves injecting at high velocity a mixture of air and abrasive particles, such as alumina or silicon carbide, after the annealing process. This removes carbon deposits by abrasion. However, this method is impractical for use with coiled pipes and is solely limited to use with straight pipe lengths.

Finally, by injecting a gaseous mixture of oxygen and inert gases into the pipe prior to the heating treatment, it is possible to achieve residual amounts of carbon in the order of 0.3 mg/dm$^2$. During this heat treatment step in a furnace, generally in a reducing atmosphere, the oxygen reacts with the residual hydrocarbons of the drawing lubricant which have remained inside the pipe and form volatile gases, such as carbon monoxide or carbon dioxide. These volatile gases are easily driven out of the pipe. It is critical to regulate the oxygen content in the gaseous mixture to prevent the formation of powderous oxide deposits inside the pipe during the heat treatment step. It is known that powderous oxide deposits, particularly in a thick layer are generally porous and have little adherence to the metal substrate.

Such an oxide layer behaves similar to carbon deposits and gives rise to pitting corrosion. Research has shown that phosphorous copper pipes containing even less than 1 mg/dm$^2$ carbon, but covered on their inside surface by powderous oxides formed during heat treatment, in slightly oxidizing conditions, have a tendency towards corrosion by pitting which is notably due to the presence of such oxide film.

The major disadvantage of the above prior art methods is that the carbon content is not sufficiently reduced which results in some degree of corrosion. Furthermore, the present state of the art has shown a desire to avoid the formation of an internal oxide layer.

SUMMARY OF THE INVENTION

The present invention overcomes the above-discussed disadvantages and other deficiencies of the prior art by providing a novel corrosion resistant phosphorous copper or phosphorous copper alloy pipe and method of manufacture thereof.

A novel corrosion resistant phosphorous copper pipe in accordance with the present invention has a carbon content on the interior surface of the pipe of 0.05 mg/dm$^2$ or less and has an internal coating of oxides, which adhere to the basic metal, with a thickness of between 0.1 and 5 microns. The oxide deposit of this novel corrosion resistant phosphorous copper pipe adheres to the basic metal and visually appears to resist cracking when the pipe is subjected to a bending deformation through a 45° angle. It has been observed that this novel corrosion resistant phosphorous copper pipe is less vulnerable to corrosion by pitting or blistering.

The method of manufacturing the novel corrosion resistant phosphorous copper pipe involves first degreasing the pipe after the drawing operation. Next the pipe is subjected to a conventional heat treatment following the degreasing step. Finally, the pipe is subjected to a subsequent heating treatment step after it is injected with a gaseous mixture containing oxygen, helium, and argon. The oxygen reacts with the last traces of residual carbon to reduce the carbon content on the inside wall and at the same time form an adhering oxide layer to the basic metal.

Accordingly, the present invention has, as some of its numerous objectives, the further reduction of the carbon content on the inside wall while producing an oxide layer which adheres to the basic metal and improves the corrosion resistance of the pipe.

BRIEF DESCRIPTION OF THE DRAWINGS

The present invention may be better understood and its numerous objects and advantages will be apparent to those skilled in the art by reference to the accompanying drawings.

DESCRIPTION OF THE PREFERRED EMBODIMENT

In accordance with the present invention a corrosion resistant phosphorous copper or phosphorous copper alloy pipe is provided with a carbon content on the inside wall of 0.05 mg/dm$^2$ or less and an internal coating of an oxide adhering to the basic metal with a thickness ranging between 0.1 and 5 microns. As a general rule, the lower the carbon content of the pipe the thinner the layer of oxide which is required. Preferably, the carbon content range is between 0.01 and 0.025 mg/dm$^2$ with a corresponding layer of oxide having a thickness between 0.1 and 3 microns.

Figure 1:
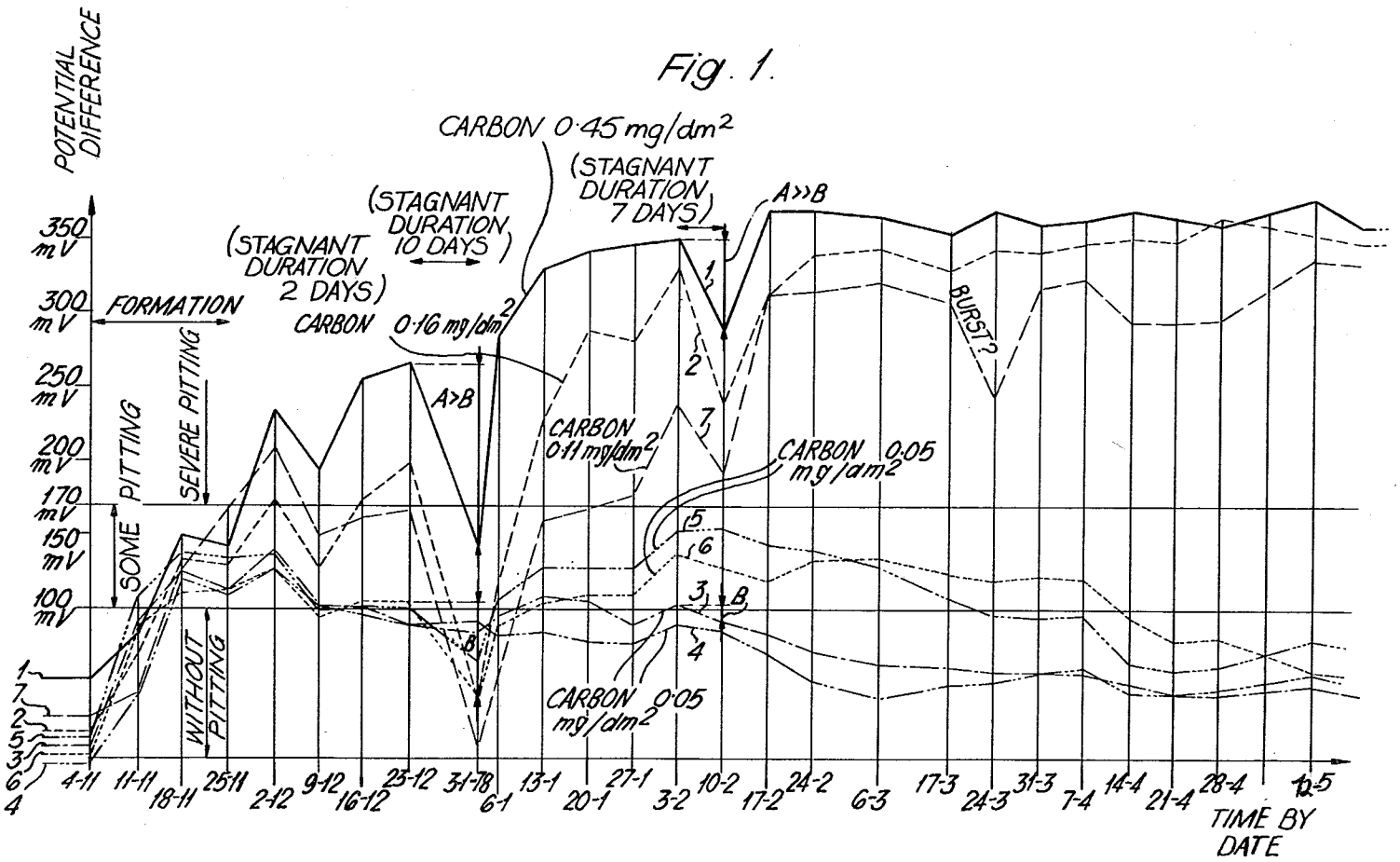
FIG. 1 is a chart illustrating the corrosion of phosphorous copper or phosphorous copper alloy pipes with varying carbon contents as a function of potential difference and time.

Referring now to FIG. 1, a chart illustrating the corrosion of phosphorous copper or phosphorous copper alloy pipes, having a specified carbon content, as a function of potential difference and time is seen. Research has shown that the pitting corrosion of phosphorous copper pipes can be determined by the potential difference measured in millivolts between an electrode placed axially in the pipe interior and the inside wall of the pipe; "Pitting corrosion in copper tubes in cold water service", F. J. Cornwell, G. Wildsmith, P. T. Gilbert *British Corrosion Journal,* 1973, vol. 8, September. It was observed that pipes having a potential difference remaining less than 170 millivolts have not been observed to exhibit pitting corrosion tendencies in cold water, not even in chemically aggressive water.

In FIG. 1 the phosphorous copper or phosphorous copper alloy pipes were subjected to a chemically aggressive liquid having the following characteristics:

| | |
|---|---|
| pH | 7.50 |
| TH | 40F |
| TA | 0 F |
| TAC | 26F |
| $SO_4^{=}$ | 45mg/1 |
| $Cl^-$ | 70–135 mg/1 |
| $CO_2$ | 4 mg/1 |
| conductivity | 650 to 800 $\mu\Omega^{-1}$/CM |

The values TH, TA, and TAC refer to the water hardness values expressed as French grades. The value TH refers to the French hydrotitrimetric value or total hardness. This means that a titration was conducted giving the total concentration in metallic cations with the exception of the alkaline metal cations ($Na^+$, $K^+$, $Li^+$) and $H^+$. This total hardness is due essentially to $Ca^{++}$ and $Mg^{++}$. The hardness includes also $Fe^{+++}$, $Mn^{++}$ and $Al^{+++}$, but they are in such minor amounts that they can be neglected.

The value TA refers to the French grade for the amount of free alkali and of free alkaline and alkaline-earth carbonates. Finally, the value TAC refers to the French grade for the amount of free alkali and of alkaline and alkaline-earth carbonates and bicarbonates.

Referring back to FIG. 1, curves 1, 2, and 7 correspond to standard commercially available pipes having respective carbon contents of 0.45 mg/dm$^2$, 0.16 mg/dm$^2$ and 0.11 mg/dm$^2$. These carbon contents are well below the 2 mg/dm$^2$ maximum level.

Curves 3, 4, 5 and 6 correspond to pipes prepared according to the present invention, all having a carbon content of 0.05 mg/dm$^2$ and an interior oxide layer with a mean thickness of 1 micron. As is seen in FIG. 1, curves 3, 4, 5 and 6 remained below the 170 mV level throughout the extended time period. As was discussed above, pipes which exhibit a potential difference which remains less than 170 mV exhibit no pitting corrosion tendency in cold water, not even in chemically aggressive water.

Furthermore, it was found that even after one year of service the interior pipe walls of pipes prepared according to the present invention showed no sign of incipient corrosion pitting. On the other hand, a phosphorous copper or phosphorous copper alloy pipe with a low carbon content, (e.g. 0.15 mg/dm$^2$) that is to say well below the generally admitted value of 2 mg/dm$^2$, but with no internal oxide layer produced in accordance with the invention is still liable to pitting corrosion in cold water. It is also noted that the potential difference between an axially introduced electrode and the inside wall of a phosphorous copper or phosphorous copper alloy pipe, without the internal oxide layer of the invention, is greater than 170 mV and that incipient pitting may be found after a period of eight months.

Again referring to FIG. 1 it is to be noted that "stagnation x days" in the chart represent periods of time during which the water in the pipes were kept stagnant. A decline in the potential difference was observed during these periods, however, the initially measured potential difference values were rapidly restored as soon as the water circulation was resumed.

Figure 2:
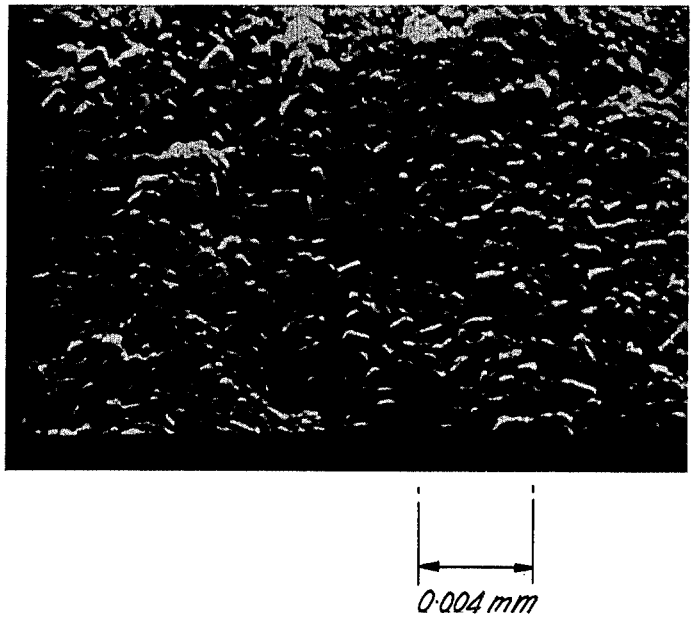
FIG. 2 is a microphotograph of the oxide layer adhering to the interior pipe walls.

Referring now to FIG. 2 a microphotograph, (enlargement×4750), illustrates the oxide layer adhering to the interior surface of the pipe walls.

The method of manufacturing a pipe according to one embodiment of the present invention involves first degreasing the interior of the pipe by means of a solvent, after completing the drawing process. The degreased pipes are then subjected to a conventional heat treatment at 700° C. The novelty of the present invention involves subjecting the pipes to a subsequent heating step at a temperature of approximately 650° C. in a special furnace. An atmosphere containing a volume percentage of about 15% oxygen and a complementary volume percentage of a gaseous mixture comprised of 25% helium and 75% argon is injected into the pipe prior to this subsequent heat treatment. The conventional degreasing by injection of a solvent and the conventional heat treatment are performed according to any known method.

It is believed that during the subsequent heat treatment the oxygen in the gaseous mixture reacts with the last traces of carbon. This permits a lowering of the residual carbon to amounts as low as 0.05 mg/dm$^2$, while at the same time forming an adhering oxide layer. It is further believed that the prior degreasing step and heat treatment step confers a desired characteristic on the base metal to allow adherence of the oxide deposits which are formed by the subsequent heat treatment. It is to be noted that this is merely a theory and should not be taken in any manner to limit the scope of the present invention.

While the preferred embodiment has been shown and described, various modifications and substitutions may be made thereto without departing from the spirit and scope of the invention. Accordingly, it must be understood that the present invention has been described by way of illustration and not limitation.

What is claimed is:

1. A method of manufacturing an improved corrosion resistant pipe comprised primarily of phosphorous copper, the method comprised of the following steps;

forming a pipe by a drawing method;

removing the residue lubricants with a solvent;

heating the pipe to 700° C.;

injecting an atmosphere comprised of 15% by volume oxygen, and 85% by volume of a gaseous mixture comprised of 25% helium and 75% argon; and heating the pipe to 650° C.

2. A method for improving the corrosion resistance of pipes comprised primarily of phosphorous copper, the method comprised of the following steps;

injecting an atmosphere comprised of 15% by volume oxygen, and 85% by volume a gaseous mixture comprised of 25% helium and 75% argon; and heating the pipe to 650° C.

3. The method of claim 2 further including the following steps;

removing the residue lubricants from the drawing process; and heating the pipe to 700° C.

* * * * *